US010798785B2

(12) United States Patent
Schlipf

(10) Patent No.: US 10,798,785 B2
(45) Date of Patent: Oct. 6, 2020

(54) HEAT-CONDUCTING BODY FOR A NOZZLE HEATER AND NOZZLE HEATER

(71) Applicant: TÜRK & HILLINGER GMBH, Tuttlingen (DE)

(72) Inventor: Andreas Schlipf, Tuttlingen (DE)

(73) Assignee: TÜRK & HILLINGER GMBH, Tuttlingen (DE)

( * ) Notice: Subject to any disclaimer, the term of this patent is extended or adjusted under 35 U.S.C. 154(b) by 531 days.

(21) Appl. No.: 15/347,226

(22) Filed: Nov. 9, 2016

(65) Prior Publication Data

US 2017/0135158 A1 May 11, 2017

(30) Foreign Application Priority Data

Nov. 11, 2015 (DE) ..... 20 2015 106 069 U

(51) Int. Cl.
*H05B 3/40* (2006.01)
*H05B 3/42* (2006.01)

(52) U.S. Cl.
CPC ..... *H05B 3/40* (2013.01); *H05B 3/42* (2013.01); *H05B 2203/003* (2013.01)

(58) Field of Classification Search
CPC ..... H05B 3/40; H05B 3/42; B29C 45/1782; B29C 45/2737
USPC ..... 425/549; 219/535
See application file for complete search history.

(56) References Cited

U.S. PATENT DOCUMENTS

| | | | | |
|---|---|---|---|---|
| 5,324,191 | A * | 6/1994 | Schmidt | B29C 45/2735 264/297.2 |
| 2003/0143302 | A1* | 7/2003 | Schwarzkopf | B29C 45/1782 425/549 |
| 2006/0018990 | A1 | 1/2006 | Bazzo et al. | |
| 2007/0188562 | A1* | 8/2007 | Fieck | B29C 45/2738 347/65 |
| 2009/0032519 | A1 | 2/2009 | Schlipf | |
| 2010/0089893 | A1 | 4/2010 | Schlipf | |
| 2014/0042148 | A1* | 2/2014 | Spuller | H05B 3/42 219/535 |

FOREIGN PATENT DOCUMENTS

| | | | | |
|---|---|---|---|---|
| CN | 203600573 U | 5/2014 | | |
| DE | 683 277 A | 11/1939 | | |
| DE | 683 277 C1 * | 11/1939 | | H05B 3/16 |
| DE | 20 2007 010 865 U1 | 10/2007 | | |
| DE | 20 2009 011 904 U1 | 12/2009 | | |

(Continued)

*Primary Examiner* — Ibrahime A Abraham
*Assistant Examiner* — John J Norton
(74) *Attorney, Agent, or Firm* — McGlew and Tuttle, P.C.

(57) ABSTRACT

A heat-conducting body (110, 210, 310, 410, 510, 610, 710, 810), for a nozzle heater (100, 200, 300, 400, 500, 600, 700, 800) has a groove with a bottom (913, 943) or a plurality of grooves with a bottom (913, 943) each. The one groove or the plurality of grooves has/have a first section (111, 211, 311, 411, 511, 611, 711, 811, 911) and a second section (512, 712, 912). The first section and the second section cross or intersect each other at least at one point. A depth of the first section (111, 211, 311, 411, 511, 611, 711, 811, 911) differs from a depth of the second section (512, 712, 912) at least at the points at which the first section (111, 211, 311, 411, 511, 611, 711, 811, 911) and the second section (512, 712, 912) cross each other.

7 Claims, 11 Drawing Sheets

(56) References Cited

FOREIGN PATENT DOCUMENTS

| | | | |
|---|---|---|---|
| DE | 10 2013 013 127 | A1 | 2/2014 |
| EP | 1 051 059 | B1 | 9/2004 |
| EP | 2 177 388 | A2 | 4/2010 |
| EP | 2177338 | A1 | 4/2010 |
| JP | 2006080058 | A | 3/2006 |

* cited by examiner

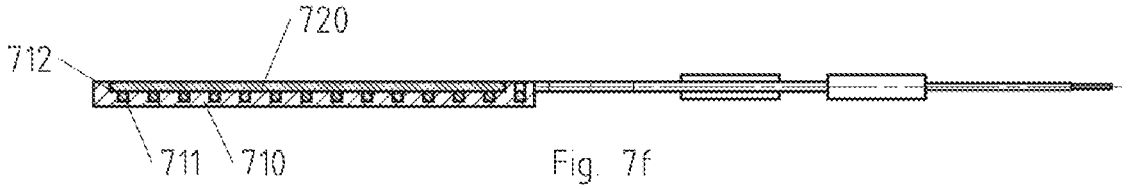
Fig. 7f
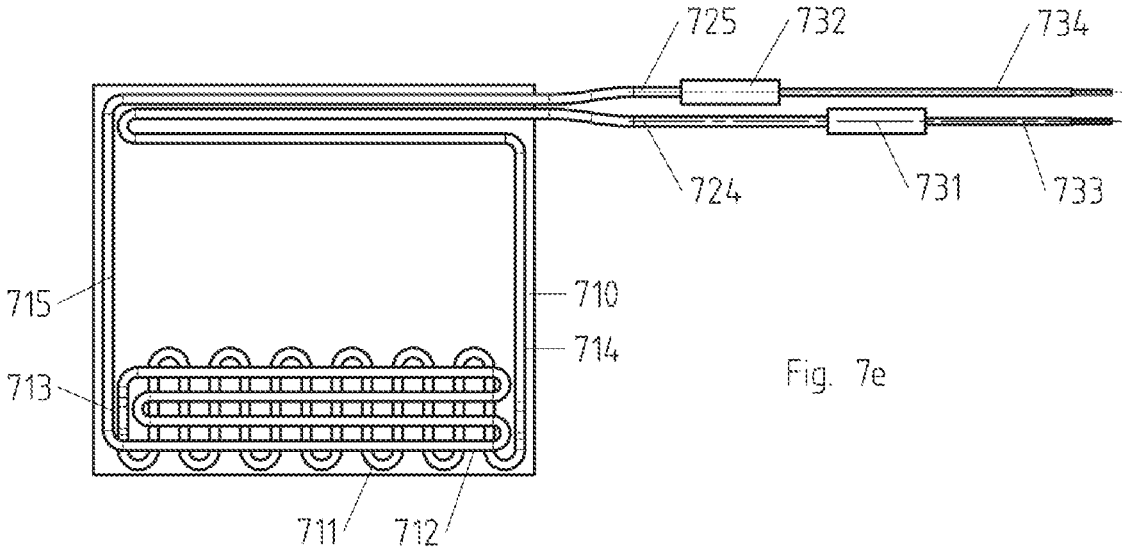
Fig. 7e
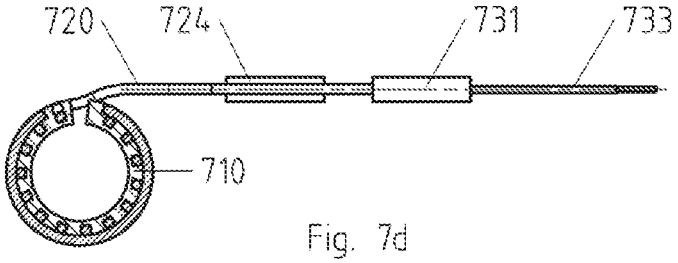
Fig. 7d
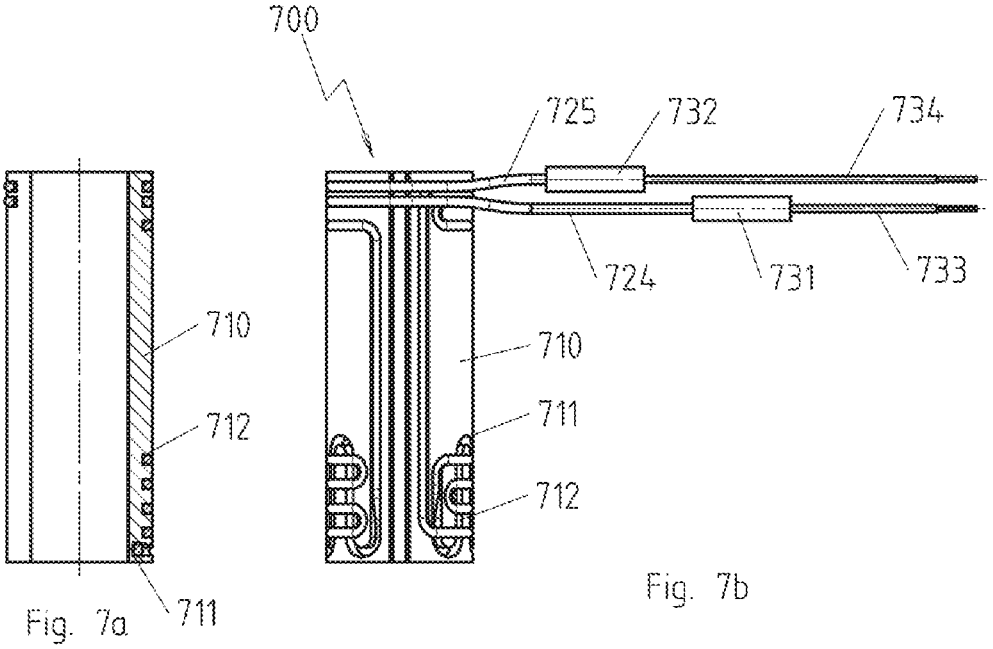
Fig. 7a
Fig. 7b

HEAT-CONDUCTING BODY FOR A NOZZLE HEATER AND NOZZLE HEATER

CROSS REFERENCE TO RELATED APPLICATIONS

This application claims the benefit of priority under 35 U.S.C. § 119 of German Application 20 2015 106 069.6 filed Nov. 11, 2015, the entire contents of which are incorporated herein by reference.

FIELD OF THE INVENTION

The present invention relates to a nozzle heater with a heat-conducting body.

BACKGROUND OF THE INVENTION

Nozzle heaters are electrical heaters, in which a heat-conducting body is provided with a central opening, into which a component to be heated, usually a nozzle to be heated, can be inserted, wherein it can be ensured in most cases by additional measures, e.g., clamping means, that there is an intimate thermal contact between the component to be heated and the nozzle heater or the heat-conducting body thereof.

The heat-conducting bodies, which are usually manufactured from a metal, are heated, in turn, by an electrical heater. The electrical heater may be configured especially as a coiled tube cartridge, i.e., as a flexible metal jacket, in the interior space of which a heating wire is embedded in an electrically insulating material, which does, however, have good thermal conductivity, e.g., magnesium oxide powder, and is electrically insulated by this from the flexible metal jacket. Depending on the course of the electrical heater, a desired temperature profile can then also be provided on the heat-conducting body, for example, by winding with variable pitch.

To make it possible to provide such a profile reproducibly and permanently, it is inherently necessary, on the one hand, to position the electrical heating element accurately and, on the other hand, to take measures that protect this element against a change in position, e.g., the slipping of a coil on the heat-conducting body. To guarantee this, it is known that the three-dimensional curve, which shall be described through the electrical heating element in a given nozzle heater on the heat-conducting body, can be defined by a groove prepared in the heat-conducting body, into which groove the electrical heating element is then inserted.

Nozzle heaters according to this state of the art and heat-conducting bodies for such nozzle heaters are known, for example, from EP 1 051 059 B1, DE 20 2009 011 904 U1, EP 2 177 388 B1 or DE 10 2013 013 127 A1.

SUMMARY OF THE INVENTION

It is, however, seen in practice that not only do the prior-art nozzle heaters continue to be desired concerning the temperature profiles that can be obtained on the heat-conducting body, but the temperature profiles that can be obtained are, moreover, also associated in many cases with high manufacturing costs. The object of the present invention is therefore to provide a heat-conducting body that is improved especially with respect to these aspects for a nozzle heater and a nozzle heater that is improved especially with respective to these aspects.

The heat-conducting body according to the present invention for a nozzle heater has a groove arrangement comprising a groove with a bottom or a plurality of grooves with a bottom. It is essential for this present invention in this connection that the one groove or the plurality of grooves have a first section and a second section, the first section and the second section crossing or intersecting one another at at least one point (at a crossing/intersection area) and a depth of the first section differing from the depth of the second section at the points at which the first section and the second section cross each other.

This special embodiment of the groove makes possible especially the local arrangement of an electrical heating element received in the groove in two planes. On the one hand, this measure leads to significantly more flexible temperature profiles that can be obtained because, for example, a crosswise arrangement of sections of the electrical heating elements becomes possible. On the other hand, a local anchoring of a section, especially of a central section of the electrical heating element, can, however, also be made possible by this measure, as a result of which the electrical heating element can be applied to the heat-conducting body more efficiently. For example, 2N windings of the electrical heating element can be wound with only N revolutions of the heat-conducting body by simultaneously winding on both sections adjoining the anchored sections of the electrical heating element, which significantly increases the production cycle compared to prior solutions.

It should be borne in mind in this connection due to the fact that the groove according to the invention must have a bottom in at least some sections, slots passing completely through the heat-conducting body, as they are shown, for example, in DE 10 2013 013 127 A1, cannot be considered to apply to the groove being claimed.

In a preferred embodiment of the heat-conducting body, the bottom of the section that is less deep at the points at which the first section and the second section cross or intersect each other is perforated at these points. This leads to a manufacturing technical simplification, because a "tunneling" can be avoided.

It is especially advantageous for at least one section of a groove or for at least one groove to have a different width compared to another section of the groove or to another groove.

If this is a greater width, so that a plurality of sections of an electrical heating element or a plurality of electrical heating elements can be placed next to each other into the section of the groove that has the greater width, it becomes possible to reach locally an especially high concentration of heat output by, for example, windings of an electrical heating element being arranged directly adjacent to one another. As an alternative, if a plurality of electrical heating elements are inserted next to one another, it is possible to obtain, for example, a nozzle heater with different heating stages in a very simple manner by adapting the electrical heating elements, especially the heat output thereof.

If this is a smaller width, so that a section of electrical heating elements can be clamped, especially under tensile stress, in the section of the groove, a simple possibility is obtained for the additional fixation of the electrical heating element.

It is especially advantageous, further, if at least one section of the groove has an undercut, so that the width of the groove is greater in the vicinity of the bottom than at the upper edge of the groove, which likewise improves the possibilities of fixation for the electrical heating element.

The nozzle heater according to the present invention has a heat-conducting body, which has a groove with a bottom or a plurality of grooves with a bottom. Further, it has at least one electrical heating element extending, in at least some sections, in the groove or in one of the grooves.

It is essential for the present invention that the one groove or the plurality of grooves have a first section and a second section, the first section and the second section crossing or intersecting each other at at least one point and the depth of the first section differing from the depth of the second section at least at the points at which the first section and the second section cross each other. The advantages of this embodiment were already discussed above in connection with a heat-conducting body configured in this manner.

An advantageous variant is also represented for the nozzle heater by the fact that the bottom of the section that is less deep at the point at which the first section and the second section cross or intersect each other is perforated at those points in order to avoid a local "tunneling."

It is preferred if a section each of an electrical heating element is arranged in the first section of the groove and in the second section of the groove, so that these sections of the electrical heating element cross or intersect one another. In other words, the nozzle heater thus configured has at least locally a multilayer arrangement of the electrical heating element or of a plurality of electrical heating elements. This makes it possible to attain a very high heat output locally.

As an alternative to this, it is, however, also possible that a plurality of grooves are present; that a section of the electrical heating element is arranged in the first section located at a first groove, and that a section of a thermocouple is arranged in the second section of the groove, which second section is located at a second groove, so that these sections of the electrical heating element and of the thermocouple cross or intersect one another. The temperature of the heat-conducting sleeve can be monitored very precisely in this manner.

Another variant of such a nozzle heater, which also represents, however, an independent possibility of accomplishing the above-mentioned object in itself, is that the electrical heating element has a section that is placed into the groove of the heat-conducting body and is wound over by another section thereof or of another electrical heating element.

It is therefore especially advantageous if the section of the electrical heating element placed into the groove of the heat-conducting body extends essentially in parallel to the insertion direction of the nozzle to be heated, which direction is obtained from the course of the opening in the heat-conducting body, into which this nozzle is inserted and can therefore directly be seen from the nozzle heater.

It is especially preferred here if the electrical heating element has a section wound on the heat-conducting body in a first winding direction and a section wound opposite the first direction on the heat-conducting body and if the section of the electrical heating element placed into the groove of the heat-conducting body is located between the section of the electrical heating element wound in the first winding direction and the section of the electrical heating element wound opposite the first winding direction. It is advantageous, in particular, if the electrical heating element is essentially U-shaped in a layout view, and a shape in which the later sections of this "U" do not extend in parallel to one another but extend towards one another starting from the connection section should, in particular, also be considered to be U-shaped.

The present invention will be explained in more detail below on the basis of figures, which represent concrete exemplary embodiments. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 7*a* is a cross sectional view through a seventh embodiment of a heat-conducting body in the wound-on state;

FIG. 7*b* is a first view of a nozzle heater with a heat-conducting body shown in FIG. 7*a* with an electrical heating element wound thereon;

FIG. 7*d* is a cross sectional view through the nozzle heater according to FIGS. 7*b* and 7*c;*

FIG. 7*e* is the wound-on heat-conducting body of the nozzle heater according to FIGS. 7*b* and 7*c* in the uncoiled state;

FIG. 7*f* is a cross sectional view through the uncoiled, wound-on heat-conducting body according to FIG. 7*e;*

DESCRIPTION OF THE PREFERRED EMBODIMENTS

Figure 1D:
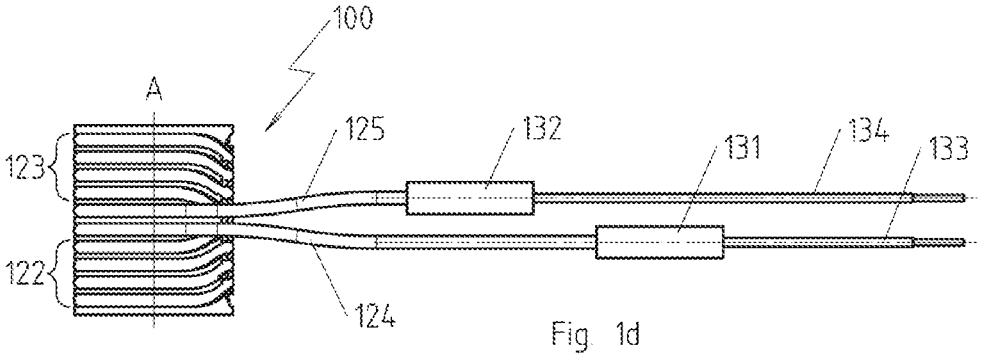
FIG. 1*d* is a view of a nozzle heater with a heat-conducting body shown in FIG. 1*a* with an electrical heating element wound thereon.

Referring to the drawings, in order not to jeopardize clarity, not all the reference numbers of an embodiment are sometimes shown in all the figures showing that embodiment. However, the reference numbers are readily apparent to the viewer from viewing the figures together.

Figure 1E:
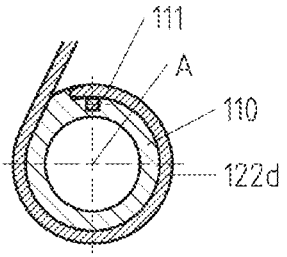
FIG. 1*e* is a cross sectional view through the nozzle heater according to FIG. 1*d;*
Figure 1A:
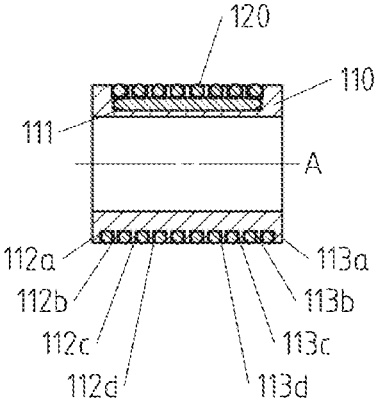
FIG. 1*a* is a cross sectional view through a first embodiment of a heat-conducting body in the wound-on state.

FIG. 1*a* shows a cross section through a first embodiment of a heat-conducting body 110 with an essentially cylindrically symmetrical basic shape, wherein the cross section extends along a plane in which extends the cylinder axis A and a first section (first groove section) 111 of a groove arrangement comprising a groove, prepared in the heat-conducting body 110, which said section extends parallel to this cylinder axis A. A first section 121 of an electrical heating element 120, which may be configured especially as a coiled tube cartridge, is inserted into the first section 111 of the groove. The heat-conducting body 110 has, further, a likewise cylindrical opening 119, which is directed coaxially with the cylinder axis, for receiving the object to be heated, especially a nozzle to be heated, which may belong, for example, to an injecting molding machine.

Figure 1B:
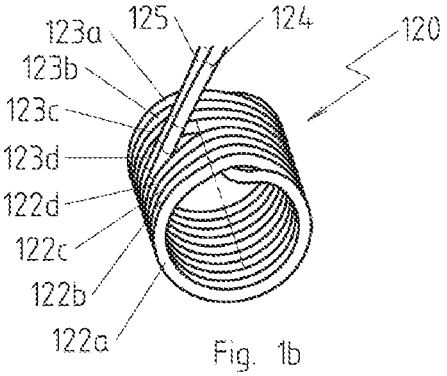
FIG. 1*b* is a first view of the three-dimensional curve, which describes an electrical heating element wound on the heat-conducting body according to FIG. 1*a;*
Figure 1C:
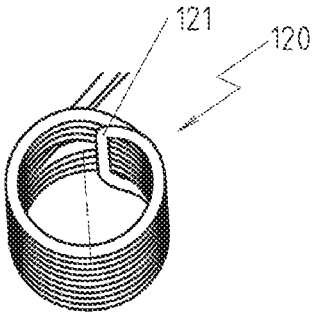
FIG. 1*c* is a second view of the three-dimensional curve, which describes an electrical heating element wound on the heat-conducting body according to FIG. 1*a;*

As it can be seen especially clearly from the view showing the three-dimensional curve, which describes the electrical heating element 120 inserted into the groove of the heat-conducting body 110 (which view corresponds to a view of the electrical heating element 120 without the heat-conducting body) according to FIGS. 1*b* and 1*c*, the electrical heating element 120 is bent by about 90° at both ends of its first section 121 and passes over into sections 122, 123 of the electrical heating element 120, which are coiled helically inwardly, i.e., in the direction of the other end of the first section 121, with four coils 122*a-d* and 123*a-d* each and then pass over each in the middle area of the heat-conducting body 110 into connection sections 124, 125, which extend in the tangential direction to this and which connection sections 124, 125 are connected to power supply lines 133, 134 via connection elements 131, 132. When viewing the three-dimensional curve described by the electrical heating element 120 in the uncoiled state, an essentially U-shaped course is thus obtained, in which the lateral legs of the U do, however, extend towards one another.

The electrical heating element 120 with the section 121 accordingly has a section that is inserted into the groove of the heat-conducting body 110, namely, into the first section 111 thereof, and is wound over with at least one other section of the same electrical heating element 120, namely, with each of the coils 112*a-d* and 123*a-d*, which can be seen especially clearly from FIG. 1*a*. As is seen, e.g., in FIG. 1*e*, the section 121 of the electrical heating element 120 inserted into the groove of the heat-conducting body 110 extends essentially parallel to the insertion direction of the nozzle to be heated, which corresponds to the orientation of the axis A.

When tracing the course of the electrical heating element 120 starting from a connection section 124, the coils 122*a-d* are wound on the heat-conducting body 110 in a first winding direction, namely, to the left in the view shown in FIG. 1*d*, i.e., in the direction in which the bent fingers of the left hand point, when the thumb points upward on the drawing in the direction of the letter A, and the coils 123*a-d* are wound to the right, i.e., in the direction in which the bent fingers of the right hand show when the thumb points upward in the drawing in the direction of the letter A, and consequently opposite the first winding direction on the heat-conducting body 110, and the section 121 of the electrical heating element inserted into the section 111 of the groove of the heat-conducting body 110 is located between the section of the electrical heating element 120 that is wound in the first winding direction and the section of the electrical heating element 120 wound opposite the first winding direction. Since, as was mentioned, the electrical heating element 120 is inserted into the groove in the heat-conducting body 110, it is also seen in this view that the groove is bent by about 90° at both ends of the first section 111 of the groove and then continues in four coils 112*a-d* and 113*a-d* each helically inwardly, i.e., in the direction of the other end of the first section 111. As is seen especially clearly in the sectional view in FIG. 1*e*, the depth of the groove is smaller in the area of the coils 112*a*-112*d* and 113*a*-113*d* than in the first section 111 thereof, which the coils 112*a*-112*d* and 113*a*-113*d* cross, so that the groove of the heat-conducting body 110 has a first section 111 and a second section (groove section), the first section 111 and the second section crossing or intersecting each other at at least one point (intersection/crossing area) and the depth of the first section differing from the depth of the second section at at least the points at which the first section and the second section cross each other.

The greater depth of the first section 111 of the groove makes it possible in this embodiment to anchor the section 121 of the electrical heating element, which can then be wound into the further course of the groove simultaneously with both sections adjoining same section after insertion into this section of the groove.

The configuration of the embodiment of a nozzle heater 200 with a heat-conducting body 210, which is shown in FIGS. 2*a* through 2*e*, differs from that of the nozzle heater 100 only in respect to the geometry of the heat-conducting body 210, so that components of the nozzle heater 200 that are not described separately below are designated by reference numbers that are obtained by adding 100 to the reference numbers of the corresponding components of the nozzle heater 100 with a heat-conducting body 110 in FIGS. 1*a* through 1*e*, and the description of these figures can be applied to FIGS. 2*a* through 2*e* with corresponding adaptations, unless indicated otherwise below.

Figure 2D:
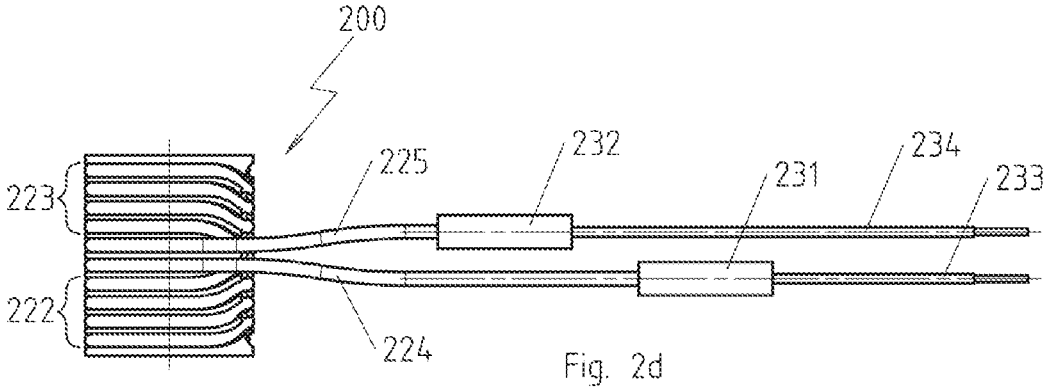
FIG. 2*d* is a view of a nozzle heater with a heat-conducting body shown in FIG. 2*a* with an electrical heating element wound thereon.
Figure 2E:
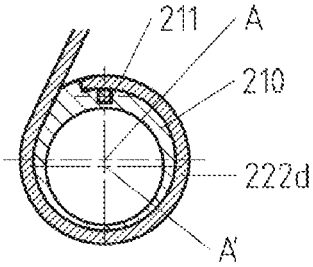
FIG. 2*e* is a cross sectional view through the nozzle heater according to FIG. 2*a;*
Figure 2A:
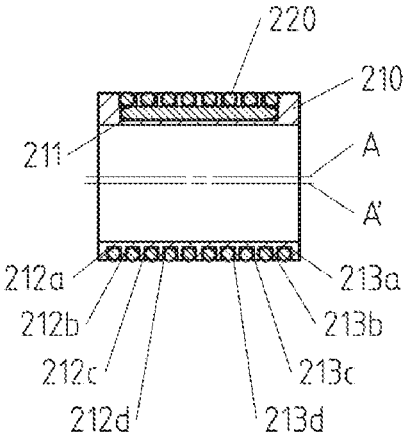
FIG. 2*a* is a cross sectional view through a second embodiment of a heat-conducting body in the wound-on state.
Figure 2B:
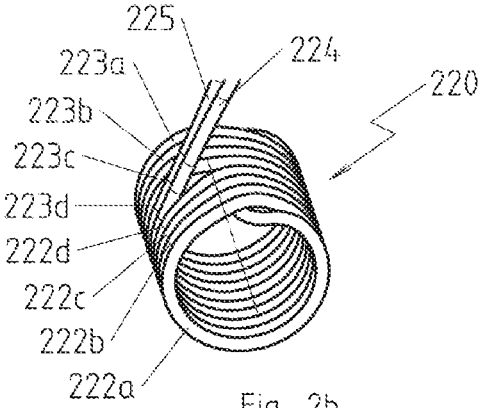
FIG. 2*b* is a first view of the three-dimensional curve, which describes an electrical heating element wound on the heat-conducting body according to FIG. 2*a;*
Figure 2C:
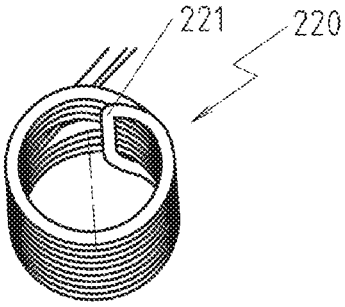
FIG. 2*c* is a second view of the three-dimensional curve, which describes an electrical heating element wound on the heat-conducting body according to FIG. 2*a;*
Figure 3D:
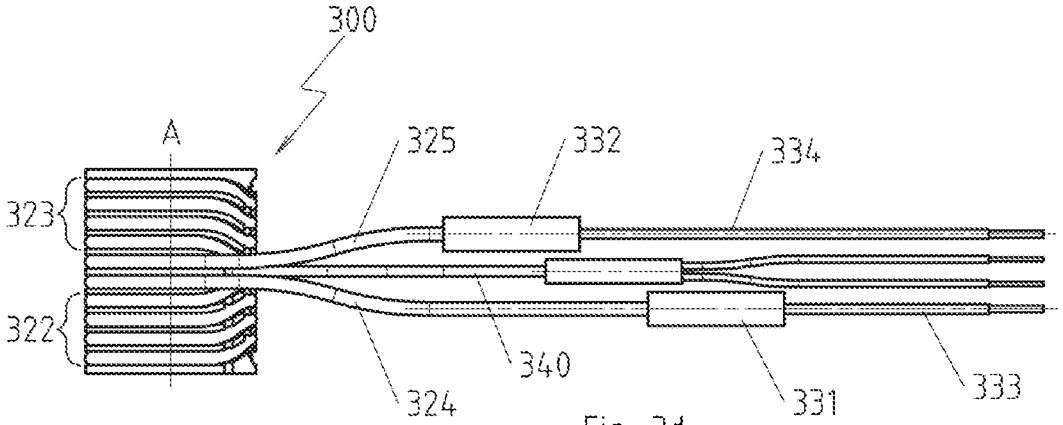
FIG. 3*d* is a view of a nozzle heater with a heat-conducting body shown in FIG. 3*a* with an electrical heating element wound thereon.
Figure 3E:
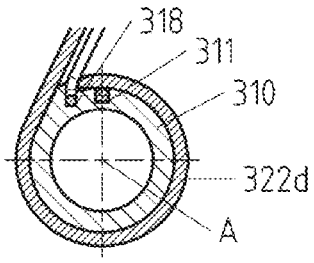
FIG. 3*e* is a cross sectional view through the nozzle heater according to FIG. 3*a;*
Figure 3A:
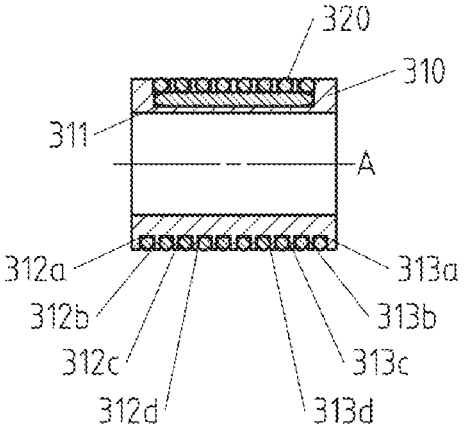
FIG. 3*a* is a cross sectional view through a third embodiment of a heat-conducting body in the wound-on state.
Figure 3B:
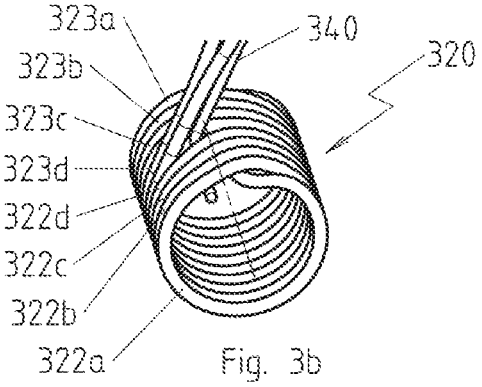
FIG. 3*b* is a first view of the three-dimensional curve, which describes an electrical heating element wound on the heat-conducting body according to FIG. 3*a* and a thermocouple arranged thereon.
Figure 3C:
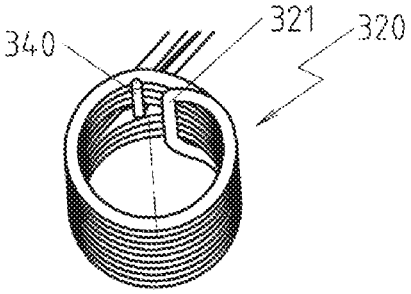
FIG. 3*c* is a second view of the three-dimensional curve, which describes an electrical heating element wound on the heat-conducting body according to FIG. 3*a* and a thermocouple arranged thereon.
Figure 4B:
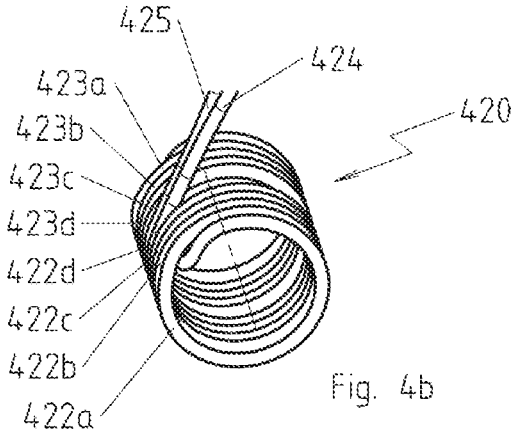
FIG. 4*b* is a first view of the three-dimensional curve, which describes an electrical heating element wound on the heat-conducting body according to FIG. 4*a;*
Figure 4A:
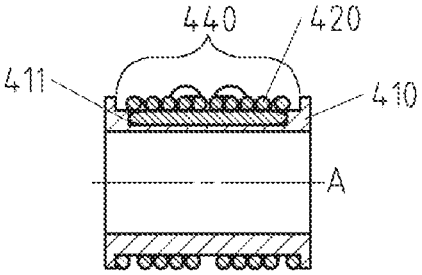
FIG. 4*a* is a cross sectional view through a fourth embodiment of a heat-conducting body in the wound-on state.
Figure 4C:
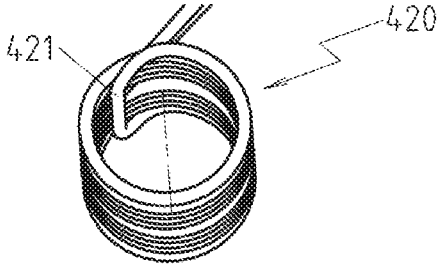
FIG. 4*c* is a second view of the three-dimensional curve, which describes an electrical heating element wound on the heat-conducting body according to FIG. 4*a;*
Figure 4E:
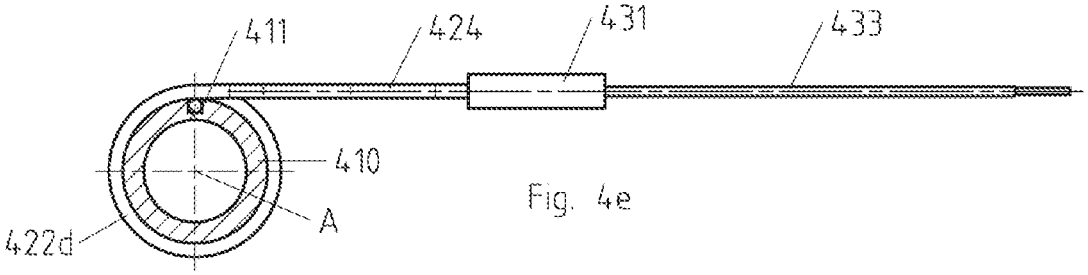
FIG. 4*e* is a cross sectional view through the nozzle heater according to FIG. 4*d;*
Figure 4D:
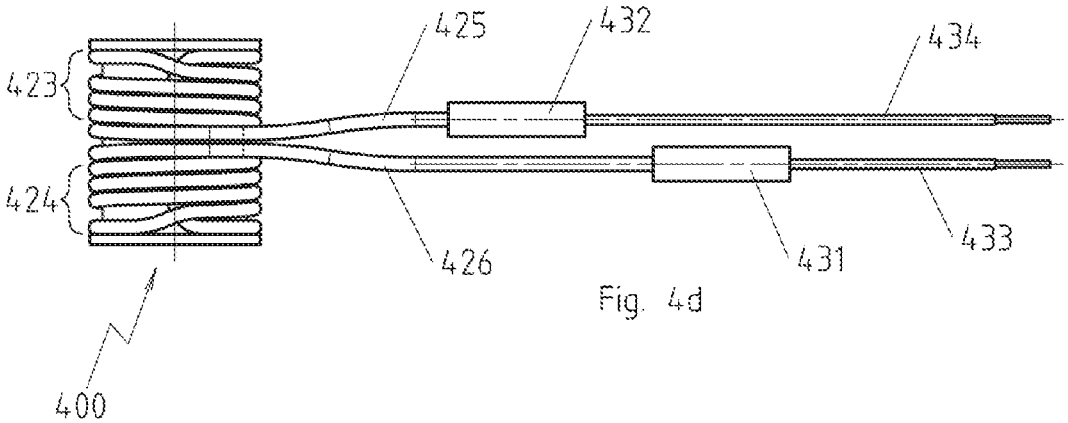
FIG. 4*d* is a view of a nozzle heater with a heat-conducting body shown in FIG. 4*a* with an electrical heating element wound thereon.
Figure 5A:
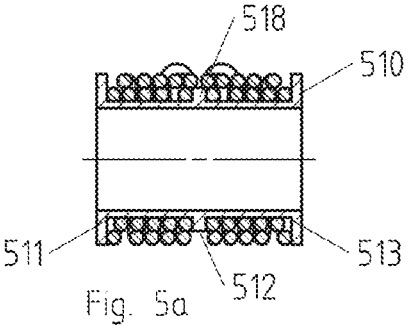
FIG. 5*a* is a cross sectional view through a fifth embodiment of a heat-conducting body in the wound-on state.
Figure 5B:
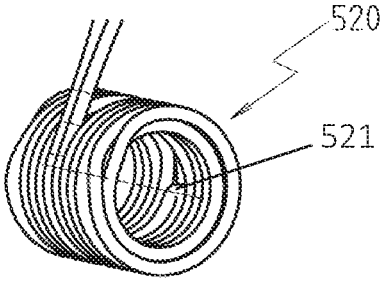
FIG. 5*b* is a view of the three-dimensional curve, which describes an electrical heating element wound on the heat-conducting body according to FIG. 5*a;*
Figure 5C:
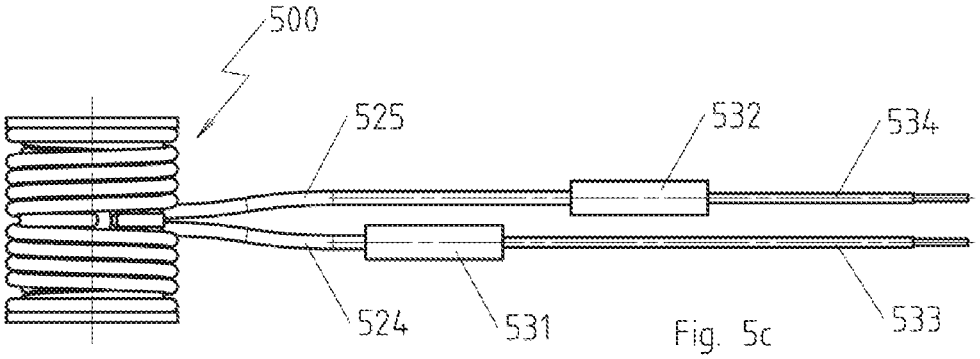
FIG. 5*c* is a first view of the nozzle heater with a heat-conducting body shown in FIG. 5*a* with an electrical heating element wound thereon.
Figure 5E:
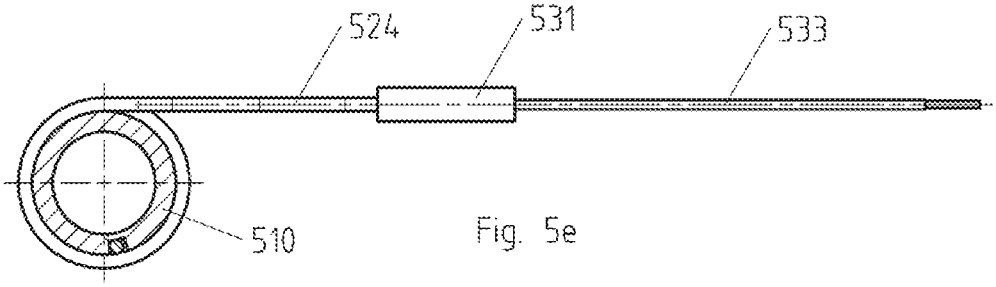
FIG. 5*e* is a cross sectional view through the nozzle heater according to FIGS. 5*c* and 5*d;*
Figure 5D:
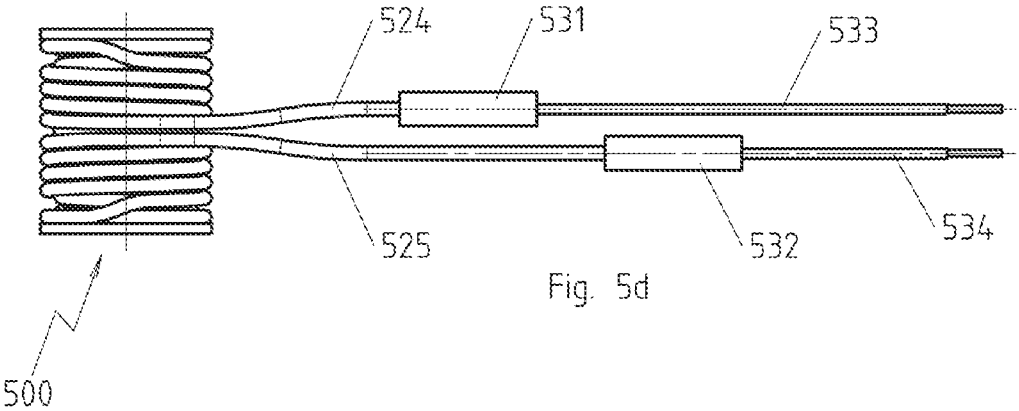
FIG. 5*d* is a second view of a nozzle heater with a heat-conducting body shown in FIG. 5*a* with an electrical heating element wound thereon, viewed from the direction opposite the direction of the view according to FIG. 5*a;*
Figure 6A:
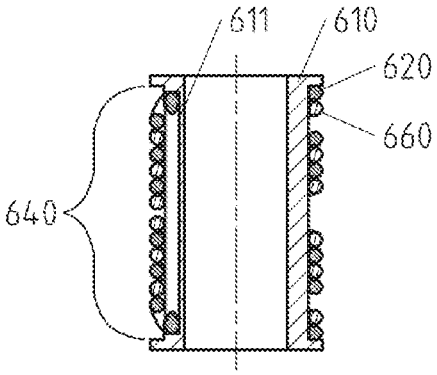
FIG. 6*a* is a cross sectional view through a sixth embodiment of a heat-conducting body in a state in which two heating elements are wound on it.
Figure 6C:
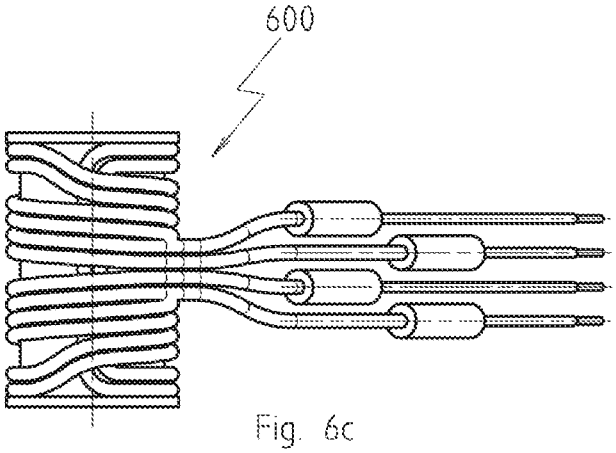
FIG. 6*c* is a first view of a nozzle heater with a heat-conducting body shown in FIG. 6*a* with an electrical heating element wound thereon.
Figure 6E:
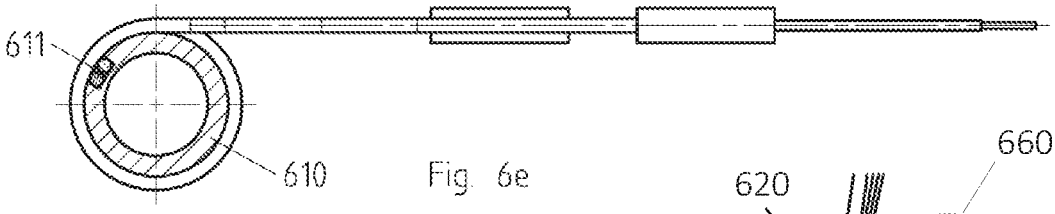
FIG. 6*e* is a cross sectional view through the nozzle heater according to FIGS. 6*c* and 6*d;*
Figure 6B:
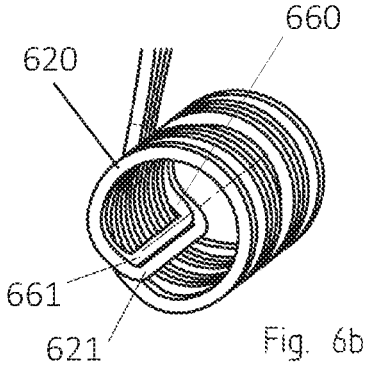
FIG. 6*b* is a view of the three-dimensional curve, which describes the path of the electrical heating elements wound on the heat-conducting body according to FIG. 6*a;*
Figure 6D:
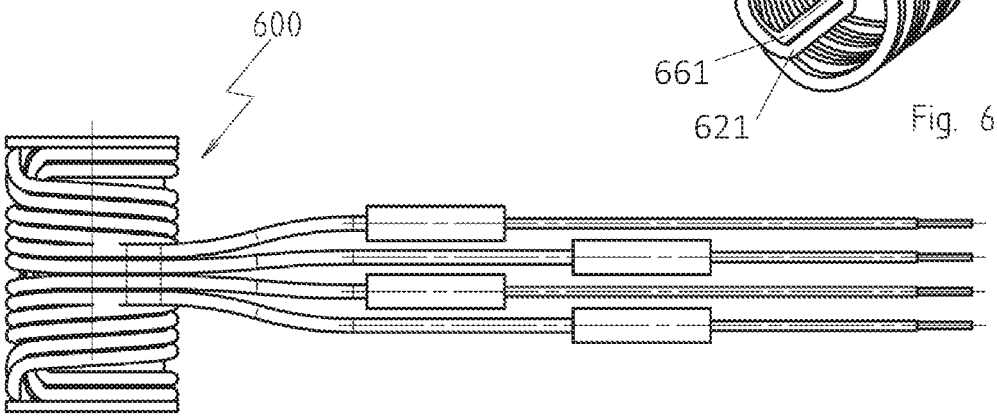
FIG. 6*d* is a second view of a nozzle heater with a heat-conducting body shown in FIG. 6*a* with an electrical heating element wound thereon, viewed from the direction opposite the direction of the view according to FIG. 5*a;*

As can be seen especially clearly in the figures, which show cross sections through the heat-conducting body 210, i.e., especially in FIGS. 2*a* and 2*e*, the heat-conducting body 210 is characterized in that it has a cylindrical opening 219 for receiving the object to the heated, which opening is not directed coaxially to the axis A contrary to the opening 119 of the first embodiment, but it has a cylinder axis A', which extends parallel to this axis A but is shifted relative to this. This will then cause the heat-conducting body 210 to have different wall thicknesses in order to make possible a greater overall depth of the groove relative to the external radius of the heat-conducting body 210 in the area in which sections of the groove cross each other, without providing the heat-conducting body 210 with a greater wall thickness everywhere.

The configuration of the embodiment of a nozzle heater 300 with a heat-conducting body 310, which is shown in FIGS. 3*a* through 3*e*, differs from that of the nozzle heater 100 only in that a thermocouple 340, which is inserted into a separate groove 318, which is likewise crossed by the wound sections 312*a*-312*d* and has a greater depth, is additionally present. The groove 318 could consequently also represent a first section in the sense of the claims.

The components of the nozzle heater 300 are otherwise designated by reference numbers that are obtained by adding 200 to the reference numbers by which the corresponding components of the nozzle heater 100 with a heat-conducting body 110 are designated in FIGS. 1*a* through 1*e*, and the descriptions of these figures can be applied with corresponding adaptations to the FIGS. 3*a* through 3*e*.

The configuration of the embodiment of a nozzle heater 400 with a heat-conducting body 410, which is shown in FIGS. 4*a* through 4*e*, differs from that of the nozzle heater 100 only in that the first groove, which has the first section 411, passes over into a second groove 440, which extends almost over the entire axial extension of the heat-conducting body in a ring-shaped manner. This groove 440, which is less deep and broader than the first section 411 and crosses the latter, is so broad that a plurality of sections of the electrical heating element 420 can be inserted next to one another.

The components of the nozzle heater 400 are otherwise designated by reference numbers that are obtained by adding 300 to the reference numbers by which the corresponding components of the nozzle heater 100 with a heat-conducting body 110 are designated in FIGS. 1*e* through 1*e*, and the description of the these figures can be applied with corresponding adaptations to FIGS. 4*a* through 4*e*.

The configuration of the embodiment of a nozzle heater 500 with a heat-conducting body 510, which is shown in FIGS. 5*a* through 5*e*, differs from that of the nozzle heater 100 with a heat-conducting body 110 only by the shape of the groove structure prepared in it and by the resulting winding of the electrical heating element 520. In the first section of the groove, a section 521 of the electrical heating element 520 extends around a central projection 518 of the heat-conducting body 510, which extends with nearly half the extension of the heat-conducting body 510 in an essentially ring-shaped manner, and separates a first section 511 of the groove, which section extends with nearly half the extension of the heat-conducting body 510, from a third section 513 of the groove, which latter section, located opposite the first section 511 in the axial direction of the heat-conducting body 510, likewise extends over nearly half the axial extension of the heat-conducting body 510 in an essentially ring-shaped manner. A second section 512 of the groove extends with a reduced depth in a ring-shaped manner essentially over the entire axial extension of the heat-conducting body 510.

This arrangement makes it possible to anchor the electrical heating element 520 with the section 521 at the central projection 518 and to subsequently wind the electrical heating element in a plurality of layers, which makes it possible to manufacture a nozzle heater 500 with extremely high heat output in a simple manner.

The configuration of the embodiment of a nozzle heater 600 with a heat-conducting body 610, which is shown in FIGS. 6*a* through 6*e*, differs from that of the nozzle heater 400 with the heat-conducting body 410 only in that the section 611 of the first groove is so broad that sections 621, 661 of a plurality of electrical heating elements 620, 660 can be inserted next to one another. As a result, central sections of the electrical heating elements 620, 660 can be anchored in this first section 611 and wound together starting from this anchoring in order to provide a nozzle heater 600 with a plurality of heating stages in a simple manner.

The components of the nozzle heater 600 are otherwise designated by reference numbers that are obtained by adding 500 to the reference numbers by which the corresponding components of the nozzle heater 100 with a heat-conducting body 110 are designated in FIGS. 1*a* through 1*e*, and the description of these figures can be applied with corresponding adaptations to the FIGS. 6*a* through 6*e*.

Figure 7C:
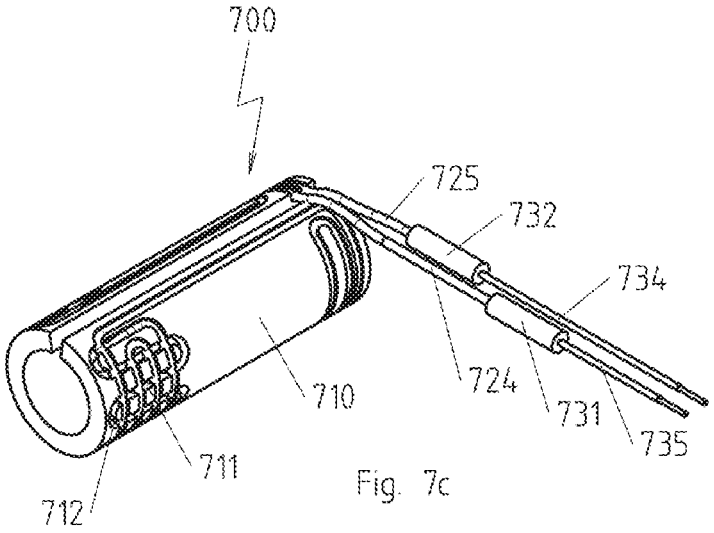
FIG. 7*c* is a second view of a nozzle heater with a heat-conducting body shown in FIG. 7*a* with an electrical heating element wound thereon.
Figure 8F:
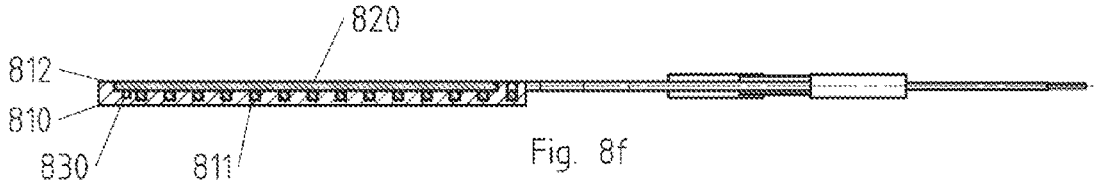
FIG. 8*f* is a cross sectional view through the uncoiled, wound-on heat-conducting body according to FIG. 8*e;*
Figure 8E:
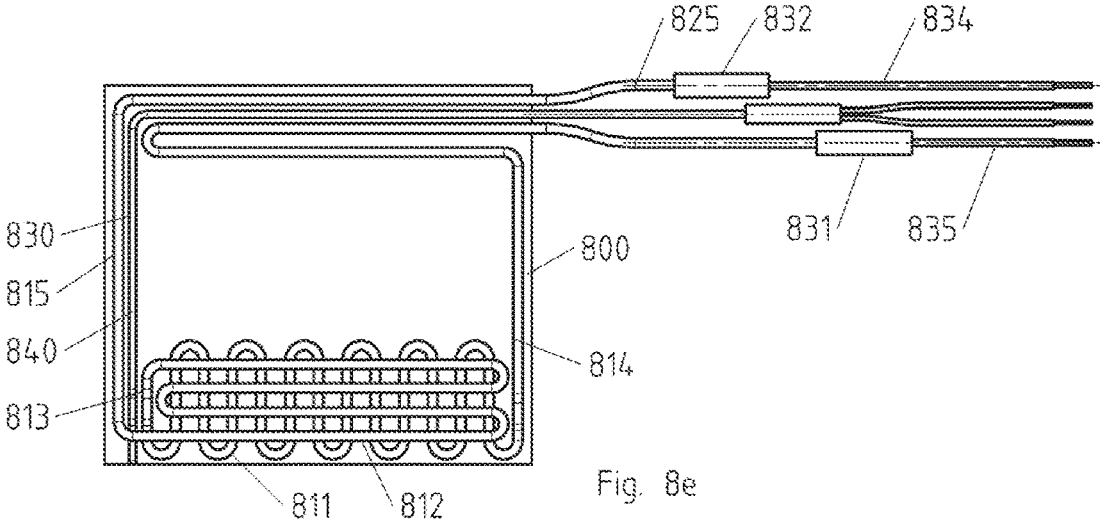
FIG. 8*e* is the wound-on heat-conducting body of the nozzle heater according to FIGS. 8*b* and 8*c* in the uncoiled state.
Figure 8A:
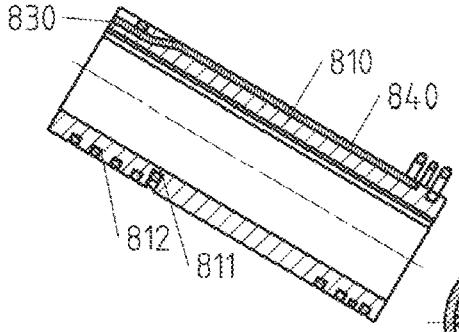
FIG. 8*a* is a cross sectional view through an eighth embodiment of a heat-conducting body in the wound-on state.
Figure 8D:
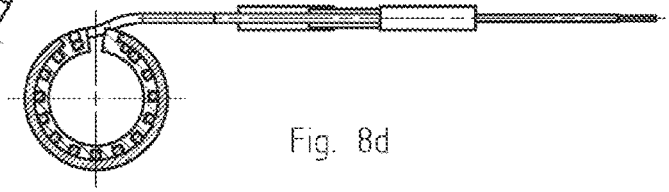
FIG. 8*d* is a cross sectional view through the nozzle heater according to FIGS. 8*b* and 8*c;*
Figure 8B:
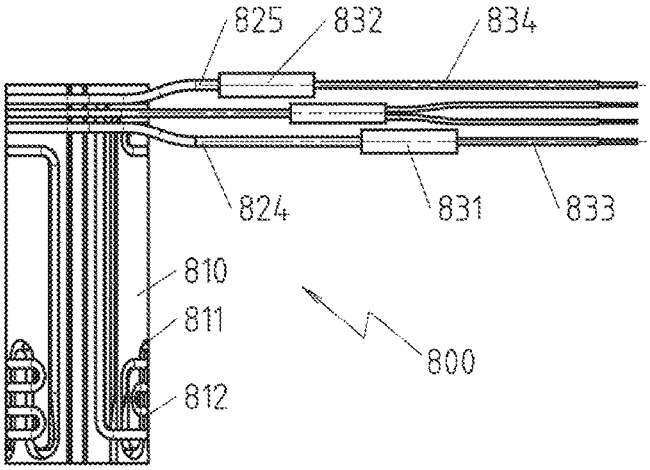
FIG. 8*b* is a first view of a nozzle heater with a heat-conducting body shown in FIG. 8*a* with an electrical heating element wound thereon.
Figure 8C:
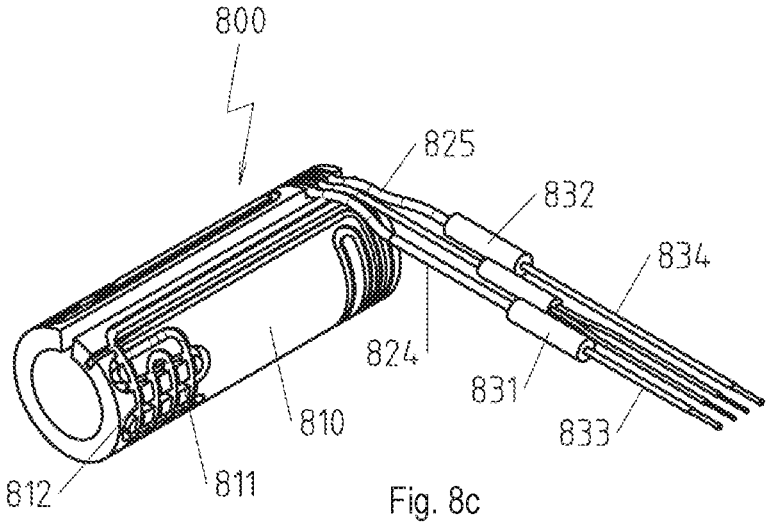
FIG. 8*c* is a second view of a nozzle heater with a heat-conducting body shown in FIG. 8*a* with an electrical heating element wound thereon.

In the nozzle heater 700 according to the seventh embodiment, which is shown in FIGS. 7*a* through 7*f*, an electrical heating element 720 is inserted into a groove, whose course can be described most simply on the basis of the uncoiled view according to FIG. 7*e*. A first section 711 of a groove extends in a meandering pattern in the axial direction, while a second section 712 of the groove, which section is less deep than the first section 711 and crosses this several times, extends in a meandering pattern in the circumferential direction of the heat-conducting body 710. Further, a transition section 713, which connects the first section 711 and the second section 712 of the groove and compensates the level difference between the bottoms of these grooves, and feed sections 714, 715, in which the electrical heating element 720 is led to the first section 711 and to the second section 712 of the groove, are present.

The nozzle heater 800, which is shown in FIGS. 8*a* through 8*f*, differs from the nozzle heater 700 only in that an additional groove 830 is present, in which a thermocouple 840 is led and which likewise crosses the second section 812 of the groove.

The components of the nozzle heater 800 are otherwise designated by reference numbers that are obtained by adding 100 to the reference numbers by which the corresponding components of the nozzle heater 700 with a heat-conducting body 710 are designated in FIGS. 7*a* through 7*f*, and the description of these figures can be applied with corresponding adaptations to FIGS. 8*a* through 8*f*.

Figure 9A:
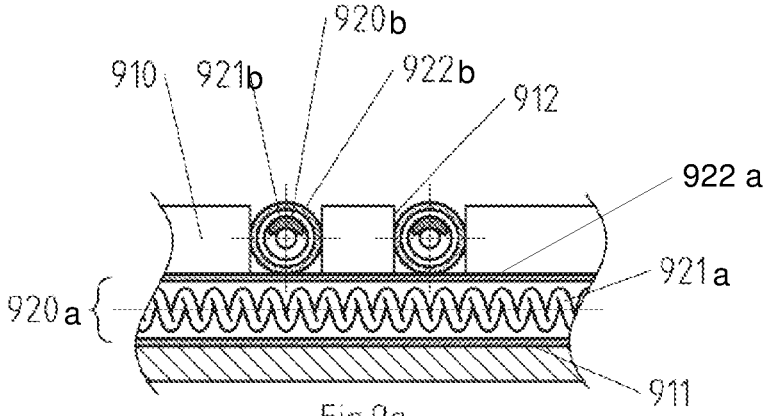
FIG. 9*a* is a detail view of a first possible embodiment of an area of a wound-on heat-conducting body, in which the first section and the second section cross each other.

FIG. 9*a* shows a detail view of a first possible embodiment of an area of a wound-on heat-conducting body 910, in which the first section 911 and the second section 912 of a groove, each provided with a respective inserted electrical heating element 920, which is configured here as a coiled tube cartridge with a heating wire coil 921, tube jacket 922 and an insulation filling, not shown, cross each other. In the area of the intersection, the second section 912 of the groove has a perforation in its bottom, so that the tube jackets 922 of the corresponding sections of the coiled tube cartridge are in direct contact with one another.

Figure 9B:
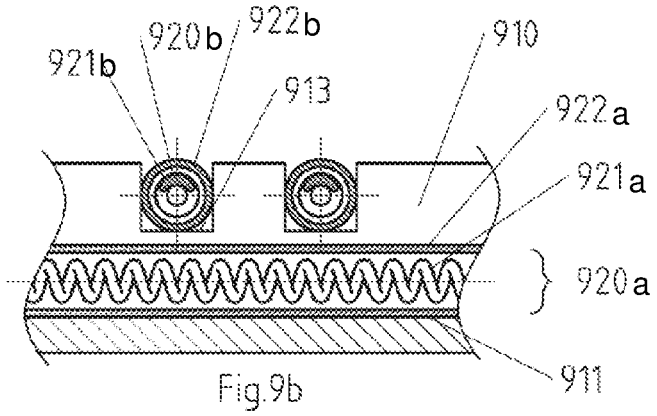
FIG. 9*b* is a detail view of a second possible embodiment of an area of a wound-on heat-conducting body, in which the first section and the second section cross each other.

Contrary to this, the bottom 913 of the second section is also present in the intersection area in the embodiment according to FIG. 9*b*, even though the configuration is otherwise the same and the same reference numbers are therefore used, so that a direct contact of the tube jackets 922 is avoided.

Figure 9C:
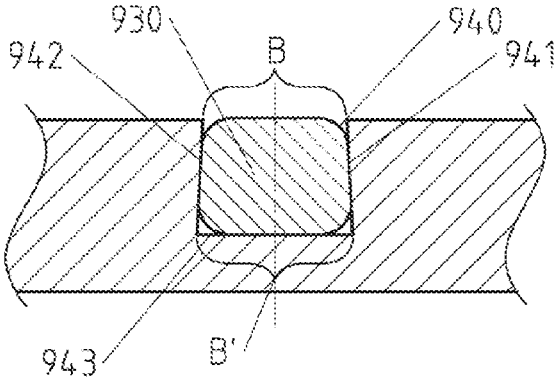
FIG. 9*c* is a detail view of a possible embodiment of the groove cross sectional view with an electrical heating element arranged in the groove.

As is shown in FIG. 9*c*, it may be advantageous if the electrical heating element 930 is inserted into a groove 940, whose side walls 941, 942 are not at right angles to the bottom 943 of the groove, but are slightly sloped inwardly, so that a width B of the groove 940 is somewhat smaller on the top side than the width B' of the groove 940 in the area of the bottom 943 thereof or, in other words, the groove 940 has an undercut.

While specific embodiments of the invention have been shown and described in detail to illustrate the application of the principles of the invention, it will be understood that the invention may be embodied otherwise without departing from such principles.

APPENDIX

List of Reference Numbers

100, 200, 300, 400, 500, 600, 700, 800
Nozzle heater
110, 210, 310, 410, 510, 610, 710, 810
Heat-conducting body
111,211,311,411,511, 611, 711, 811, 911
First section
112*a-d*, 113*a-d*, 212*a-d*, 213*a-d*, 312*a*-3, 313*a-d*
Coils
119, 219, 319, 419, 519, 619, 719, 819
Cylindrical opening
120, 220, 320, 420, 520, 620, 660, 720, 820, 920
Electrical heating element
121, 221, 321, 421
First section
122, 123, 222, 223, 322, 323, 422, 423, 521
Section
122*a-d*, 123*a-d*, 222*a-d*, 223*a-d*, 322*a-d*, 323*a-d*, 422*a-d*, 423*a-d*
Coils
124, 125, 224, 225, 324, 325, 424, 425, 524, 525, 624, 625, 724, 725, 824, 825
Connection section
131, 132, 231, 232, 331, 332, 431, 432, 531, 532, 631, 632, 731, 732, 831, 832
Connection elements
133, 134, 233, 234, 333, 334, 433, 434, 533, 534, 633, 634, 733, 734, 833, 834
Power supply line
318
Groove
340, 840
Thermocouple
440
Groove
512, 712, 912
Second section
513
Third section
518
Central projection
713
Transition section
714, 715
Feed section
830
Groove
921
Heating wire coil
922
Tube jacket
913, 943
Bottom
940
Groove
941, 942
Side walls
A, A'
Cylinder axis
B, B'
Width

What is claimed is:

1. A nozzle heater comprising:

a heat-conducting body defining a first groove section and a second groove section, each of said groove sections having a body, said first groove section and said second groove section being arranged to cross or intersect each other at a crossing/intersection area, a depth of said first groove section being different from a depth of said second groove section at said intersection area; and a heating element having a first heating section arranged in said first groove section, said heating element having a second heating section extending from one end of said first heating section, said second heating section being wound in said second groove section, said heating element having another second heating section extending from another end of said first heating section said another second heating section being wound in said second groove section.

2. The nozzle heater in accordance with claim 1, wherein:

said second heating section and said another second heating section being wound in opposite directions in said second groove section.

3. The nozzle heater in accordance with claim 1, wherein:

said heat conducting body has a cylindrical shape with an axial and circumferential direction;

said second heating section and said another second heating section being wound axially inwardly from respective said ends of said first heating section.

4. The nozzle heater in accordance with claim 1, wherein:

said heat conducting body has a cylindrical shape with an axial and circumferential direction;

said first groove section is aligned with said axial direction;

said second groove section is aligned with said circumferential direction.

5. The nozzle heater in accordance with claim 1, wherein:

said second groove section is multiple widths of said first groove section.

6. A nozzle heater arrangement comprising:

a heat-conducting body defining a first groove section and a second groove section, said first groove section and said second groove section being arranged to cross or intersect each other at a plurality of crossing/intersection areas, a depth of said first groove section being different from a depth of said second groove section at said crossing/intersection areas, said heat conducting body having a cylindrical shape with an axial and circumferential direction, said first groove section extending in a meandering pattern in said axial direction, said second groove section extending in a meandering pattern in said circumferential direction;

a heating element having a first heating section arranged in said first groove section, said heating element having a second heating section extending from one end of said heating element, said second heating section being wound in said second groove section.

7. The nozzle heater arrangement in accordance with claim 6, further comprising:

another groove defined by said heat conducting body, said another groove being arranged to cross said second groove section;

a thermocouple arranged in said another groove.

* * * * *